United States Patent [19]

McPeak

[11] 4,199,324

[45] Apr. 22, 1980

[54] MATCH CONTAINER HAVING A REMOTELY OPERABLE STRIKING CHAMBER

[76] Inventor: Walter G. McPeak, 221½ S. Blvd., Tallahassee, Fla. 32301

[21] Appl. No.: 686,498

[22] Filed: May 14, 1976

[51] Int. Cl.[2] ..... A24F 27/12; A24F 27/20

[52] U.S. Cl. ..... 44/44; 44/45; 44/48; 206/106; 206/108; 206/109

[58] Field of Search ..... 44/42–44, 44/45, 48; 206/106, 108, 109, 459

[56] References Cited

U.S. PATENT DOCUMENTS

| | | | |
|---|---|---|---|
| 483,165 | 9/1892 | Pusey | 44/45 |
| 1,123,440 | 1/1915 | Walton | 44/48 |
| 2,691,881 | 10/1954 | Knutsson-Hall | 44/45 X |
| 4,143,761 | 3/1979 | Brand | 44/44 X |

*Primary Examiner*—Carl F. Dees
*Attorney, Agent, or Firm*—Robert Brown, Jr.

[57] ABSTRACT

A combination match retainer and igniter provided with an elongated striking chamber which is laterally expanded to receive an unlighted match in response to relative sliding movement in one direction between the retainer and its cover, and which is laterally contracted in response to said relative sliding movement in the opposite direction to grip the match preparatory to withdrawal and ignition thereof.

3 Claims, 11 Drawing Figures

MATCH CONTAINER HAVING A REMOTELY OPERABLE STRIKING CHAMBER

This invention relates to consumer product safety and more particularly to articles such as match boxes and match books which, when improperly used, exacts a terrifying toll in life and property.

For many years, it has been a well-known fact that commercially available match containers of the box and book types provide inadequate safeguards against injury when igniting matches. The frequency of use by adults, especially smokers, often lulls the user into a false sense of security and results in his or her neglect of proper care when striking the matches, thereby incurring physical injury. Small children, who are not capable of exercising the ordinary care of a prudent adult, are usually attracted to match containers as a matter of curiosity, and especially by the thrill and glamour incident to withdrawal of the matches from, and the ignition of them on an exposed or easily accessible striking surface of the container.

It is reliably estimated that almost 10,000 people throughout the United States required hospital emergency treatment for match-related injuries during a 1974 fiscal year [See Preliminary Risk-of-Injury Report on Matches (1704), October 1975, U.S. Consumer Product Safety Commission]. The accident pattern relating to match usage included: "match malfunction or manufacturing defect; poor design of package; match malfunction or defect and poor design of package; and misuse, abuse, or carelessness". The latter pattern accounted for over three-fourths of the accidents of which over one-half of the victims were children 12 years old and under.

It is therefore an object of this invention to provide a match container of the class described which is so constructed and arranged as to eliminate the necessity for adults to exercise the high degree of care heretofore required to ignite the matches and, also, to eliminate the attractive nuisance characteristics which have proven so detrimental to the safety of children.

It is another object of the invention to provide a match container having a concealed striking chamber which is operable by adults only through the use of a built-in safety feature but which requires more skill to operate than that ordinarily expected of small children.

It is a further object of the invention to provide a match container consisting of a match retainer, a cover for the retainer, and an elongated striking chamber for receiving a match to be ignited, in combination with means operable in response to sliding movement between the retainer and cover in one direction for laterally expanding the chamber to permit insertion of a match, and in the opposite direction for laterally contracting the chamber to grip the match as a preliminary step to its withdrawal and ignition.

It is yet another object of the invention to provide a match container having a concealed striking chamber which is operated from a remote point on the container to assume an expanded match-receiving and a contracted match-gripping position.

Some of the objects of the invention having been stated, other objects will appear as the description proceeds when taken in connection with the accompanying drawings, in which, FIG. 1 is an isometric top view of a match book embodying the invention and with the striking chamber and cover thereof in closed positions;

Figures 1, 1A, 2, 3, 4, 5, 6, 7, 7A, 7B, 8:
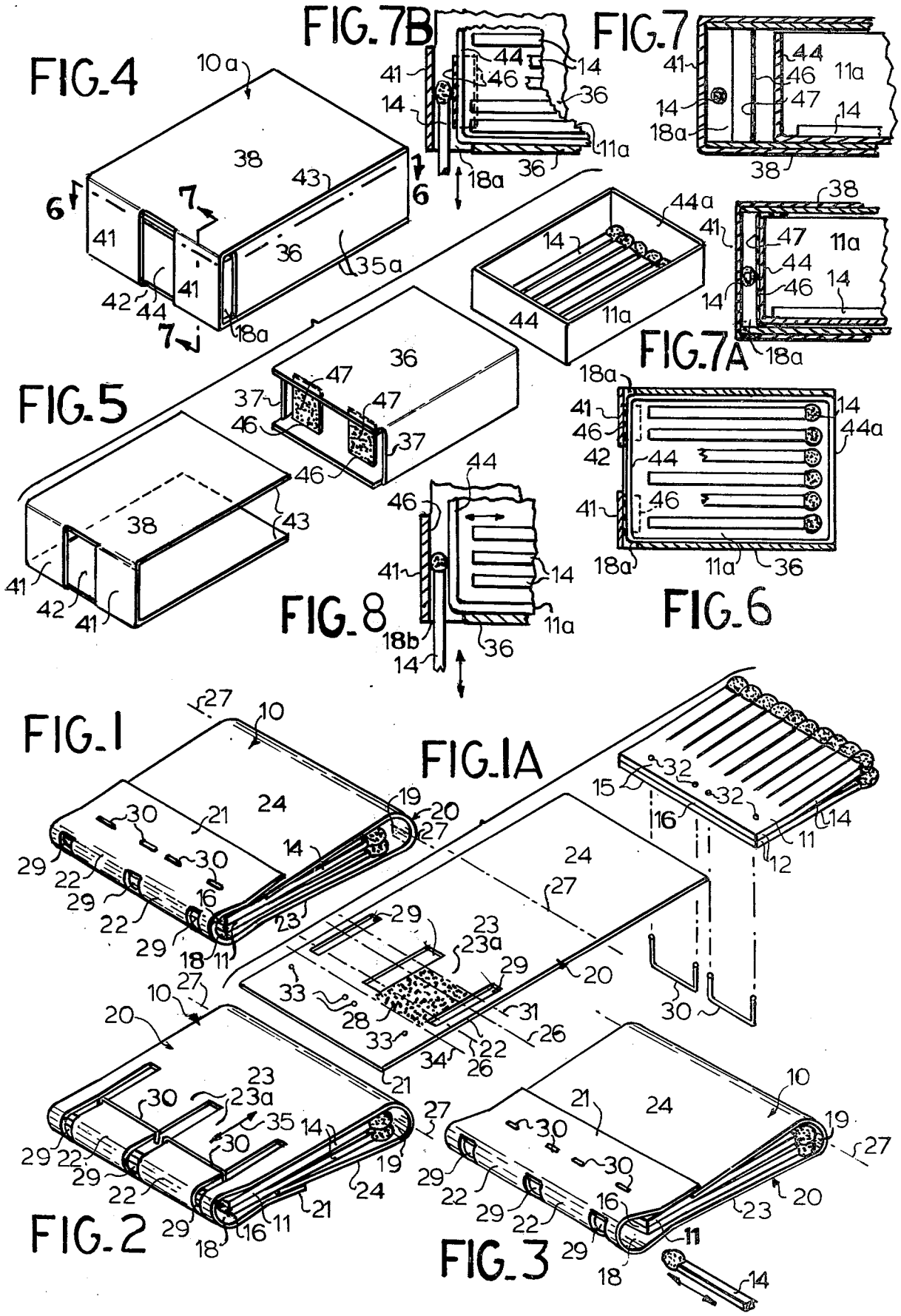
FIG. 1A is an exploded isometric view of the parts of the match book in FIG. 1.
FIG. 2 is an isometric bottom view of the match book in FIG. 1.
FIG. 3 is an isometric view similar to FIG. 1 but showing the striking chamber in an expanded open position for receiving a match.
FIG. 4 is a modified form of the invention embodied in a match box with its cover and striking chamber in closed positions.
FIG. 5 is an exploded isometric view of the parts of the match box shown in FIG. 4.
FIG. 6 is a sectional plan view taken along line 6—6 in FIG. 4.
FIG. 7 is an enlarged sectional detail view taken along line 7—7 in FIG. 4, showing the match retainer or tray and the striking chamber each in an open position, and also showing a match within the chamber before it has been gripped.
FIG. 7A is a view similar to FIG. 7 but showing the match gripped within the striking chamber.
FIG. 7B is an enlarged sectional detail plan view similar to FIG. 7A.
FIG. 8 is a view similar to FIG. 7B, showing a slightly modified form of the invention.

Referring more particularly to the drawings, the numeral 10 denotes a match book comprising a flat rectangular match splint retainer member 11 formed from the base of one or more match combs 12, each having a plurality of parallel splints 14 integral therewith. As best shown in FIG. 1A, the retainer member 11 has upper and lower parallel faces 15, 15 and a rectangular end face 16 disposed transversely of and substantially normal to faces 15. The end face 16 is also disposed transversely of the projecting parallel axes of the retained or attached match splints 14 and forms part of the inside surface of an elongated laterally expansible and contractible ignition chamber 18 more fully described hereinafter.

Briefly stated, the cover 20 comprises an open-ended U-shaped segment having leg segments 21 and 23 respectively overlying the top and bottom sides 15, 15 of retainer member 11, and a closure flap 24 forming an extension of the segment 23. More specifically, elongated flat cover member 20 is provided for the retainer 11 and attached splints 14, said cover member consisting of a top flap securing section 21, a match gripping section 22, a bottom cover section 23, and a top flap closure section 24. It will be observed that the gripping section 22 lies approximately between the dot-dash lines 26, 26 in the developed view of the cover (FIG. 1A) and, when in assembled position as shown in FIGS. 1-3, it is positioned opposite the rectangular end face 16 of retainer member 11, said member 11 and face 16 forming walls of striking chamber 18. The inside of the chamber 18 is provided with a concealed striking surface 28 (FIG. 1A). The closure flap 24 is integral with section 23 and bendable approximately about dot-dash line 27 so as to be releasably secured in a closed position underneath the flap 21 as shown in FIG. 1. The cover member 20 is further provided with parallel longitudinal slots 29 extending across gripping section 22 and into the adjacent cover sections 21 and 23.

When the developed view of the cover 20 (FIG. 1A) is compared with the top view of the match book 10

(FIG. 1), it will be observed that: the opposed sidewalls of the elongated open-ended striking chamber 18 consist of said retainer end face 16 and the opposed face of cover section 22; the bottom chamber wall consists of the cover section between the parallel dot-dash lines 26, 31; and the top chamber wall consists of the cover section between the parallel dot-dash llines 26, 34.

The retainer and cover members 11 and 20 respectively are held in assembled position by suitable means such as U-shaped staples 30. The legs of the staples first penetrate two adjacent longitudinal slots 29 in cover section 20 (FIG. 1A), then penetrate retainer member 11 at points 32, and then the top flap section 21 at 33, the ends of the staple legs projecting from the flap section 21 being crimped in a well-known manner.

It is important to note that the staples 30 slidably confine the strips 23*a* and the bottom cover section or segment 23 for longitudinal sliding reciprocatory movement relative to the retainer member 11 as indicated by arrows 35. At the same time, the crimped ends of staples 30 integrally secure member 11 to the top cover segment 21. In order to permit the reciprocatory sliding movement between segment 23 and member 11 without releasing closure flap segment 24 from beneath segment 21, the combined length of segments 23, 24 is sufficient to form the striking chamber 18 as shown in its open position in FIG. 3, or to form an elongated transverse chamber 19 of substantially the same dimensions at the heads of match splints 14 as shown in FIG. 2 when chamber 18 is closed.

To use the match book, the top cover flap 24 is opened, a match splint detached from retainer 11, and the top flap closed again to the position shown in FIGS. 1 and 2. At this time, the striking chamber 18 is closed thereby rendering the concealed striking surface 28 inaccessible. The user then grips the cover segments 21 and 23 and the intermediate retainer 11 between his forefinger and thumb to impart sliding movement to segment 23 toward the observer in FIG. 2 and to open chamber 18 to the position shown in FIG. 3, at which time, the head of a match splint 14 is inserted. Then the user imparts relative sliding movement in the opposite direction as between segment 23 on one hand, and segment 21 and retainer 11 on the other thus closing or contracting chamber into gripping contact with the inserted splint head. As the splint 14 is withdrawn, the splint head will engage striking surface 28 to ignite the the splint head.

Instead of remotely operating ignition chamber 18 by manipulating sections 21 and 23 as described above, the user may operate the chamber from an even more remote location by retracting closure flap 24 from beneath securing section 21 (FIG. 3) until only the heads of splints 14 remain covered, and then gripping the retainer 11 and the section 23 between his index finger and thumb while imparting relative reciprocatory sliding movement between the gripped parts.

FIGS. 4 through 8 illustrate a match box 10*a* embodying essentially the same elements and principle of operation as in the previously described match book 10.

The box 10*a* comprises a rectangular match splint retainer or tray 11*a* which stores and retains the splints in substantially parallel positions. A two-piece cover 35*a* for the retainer is provided (FIG. 4), said cover consisting of a rectangular open-ended casing 36 in which the tray 11*a* is slidably mounted, and also of a flat U-shaped member 38 having a central two-piece end wall 41, 41 for partially closing one end of the casing 36. The parallel legs 43, 43 of member 38 are positioned face-to-face upon the upper and lower faces of the casing. The end pieces 41, 41 have a space 42 therebetween into which the user's finger may be inserted to engage the tray end wall 44 of tray 11*a* to slide it toward open position, said pieces forming the outer matchgripping wall of the elongated striking chamber 18*a*, the inner gripping wall consisting of the tray end 44. Interposed between the gripping walls 41 and 44 is a pair of flat stretchable strips 46, 46 such as rubber. Each of the strips 46 has a striking surface 47 thereon which is pressed against the the head of match splint 14 by tray wall 44 preliminary to ignition as shown in FIGS. 7A and 7B. As shown in FIG. 5, the opposite sidewalls of casing 36 are notched as at 37, 37 to form end openings for the ignition chamber 18*a*.

When the exploded parts in FIG. 5 are compared with the closed match box in FIG. 4, it will be observed that: the end cover pieces 41, 41 serve as the outer sidewall of the chamber 18*a*; the abrasively coated strips 46 and tray end 44 as the inner sidewall; and the portions of legs 43 adjacent the upper and lower horizontal edges of pieces 41 serve as the upper and lower chamber walls. The upper edge of tray wall 11*a* is slidably connected to the upper inside surface of casing 36, whereas in the match book 10 the upper edge of the corresponding retainer wall surface 16 (FIG. 1) is fixedly connected to cover section 21.

The provision of the stretchable abrasively coated striking strips 46, 46 makes it impossible to ignite a match with the striking chamber 18*a* unless the tray 11*a* is substantially in the closed position as shown in FIG. 7B, at which time, the tray wall 44 presses the strip and the abrasive surface 47 into gripping engagement with the match head.

The operation of the match splint container 10*a* consists of: sliding the tray or retainer 11*a* to an opened position to permit removal of a match splint 14 and to simultaneously expand ignition chamber 18*a* (FIG. 7); insertion of the splint head into the chamber between outer end wall piece 41 and abrasively coated strip 46; closing the tray 11*a* so as to grip the splint head as shown in FIG. 7B; and withdrawing the splint to ignite the head thereof.

FIG. 8 is similar to FIGS. 4 through 7 except for the omission of the flexible abrasively coated strips 46 and the provision of an abrasive striking surface 46 on the inside wall faces of end pieces 41, 41 in lieu thereof.

Since the match head is gripped in the chamber 18*a* by the pressure applied by one hand of the user at a remote point on the container while the match 14 is withdrawn from the chambers by his other hand during ignition, the chances of injury from the ignited match are substantially reduced. Moreover, the provision of concealed striking surfaces within the chamber provides an additional safety feature, even in the absence of the remotely operable gripping feature.

I claim:

1. A combination safety match holder and ignition chamber comprising:

(a) a relatively flat rectangular match retainer (11);

(b) a U-shaped cover segment (22) cupped over one of the rectangular ends (16) of said retainer to form an elongated ignition chamber (18) therebetween, said chamber having at least one open end;

(c) a flat cover segment (23) forming an extension of one leg of said U-shaped segment and overlying one of the flat sides of said retainer, and (d) means (29, 30) for mounting said flat cover segment on said retainer for sliding movement transversely of said chamber in one direction to increase the distance between the proximate surfaces of said U-shaped segment and retainer end, and for transverse movement in the opposite direction to reduce said distance, whereby the chamber is expanded to match-receiving position and contracted to match-gripping position.

2. The combination defined in claim 1 wherein the wall of said chamber includes an elastic sheet (46) bridging the legs of said U-shaped segment and engagable by said retainer end (16) in response to the movement of said flat cover segment (23) toward said chamber, the face of said sheet disposed opposite the trough of said U-shaped segment being coated with a striking composition.

3. The combination defined in claim 1 wherein the other leg of said U-shaped cover segment (22) is fixedly secured to the other flat side of said retainer (11), said U-shaped segment being flexible lengthwise in the direction of said movement.

* * * * *